US010008307B1

(12) United States Patent
Lanoe et al.

(10) Patent No.: US 10,008,307 B1
(45) Date of Patent: Jun. 26, 2018

(54) HIGH FREQUENCY SHIELDED COMMUNICATIONS CABLES

(71) Applicant: Superior Essex International LP, Atlanta, GA (US)

(72) Inventors: Thibaut Oscar Lanoe, Atlanta, GA (US); Christopher W. McNutt, Woodstock, GA (US); Frank Thomas McIntire, Buchanan, GA (US); Bernhart Allen Gebs, Powder Springs, GA (US)

(73) Assignee: Superior Essex International LP, Atlanta, GA (US)

( * ) Notice: Subject to any disclaimer, the term of this patent is extended or adjusted under 35 U.S.C. 154(b) by 28 days.

(21) Appl. No.: 15/348,407

(22) Filed: Nov. 10, 2016

(51) Int. Cl.

| | |
|---|---|
| ***H01B 7/00*** | (2006.01) |
| ***H01B 11/10*** | (2006.01) |
| ***H01B 11/00*** | (2006.01) |
| ***H01B 7/295*** | (2006.01) |
| ***H01B 7/18*** | (2006.01) |
| ***H01B 7/02*** | (2006.01) |

(52) U.S. Cl.
CPC ..... *H01B 11/105* (2013.01); *H01B 7/0225* (2013.01); *H01B 7/1895* (2013.01); *H01B 7/295* (2013.01); *H01B 11/002* (2013.01); *H01B 11/1091* (2013.01)

(58) Field of Classification Search
CPC ... H01B 11/01025; H01B 11/02; H01B 11/06; H01B 11/08; H01B 7/0861; Y10T 29/49194
USPC ..... 174/102 R, 103, 106 R, 108, 110 R, 174/113 R, 120 R, 120 SC
See application file for complete search history.

(56) References Cited

U.S. PATENT DOCUMENTS

| | | | | |
|---|---|---|---|---|
| 3,819,443 | A * | 6/1974 | Simons | B32B 15/08 156/204 |
| 4,022,648 | A * | 5/1977 | Woodberry | B29C 65/008 156/273.1 |
| 4,096,346 | A * | 6/1978 | Stine | B29C 47/128 174/110 AR |
| 5,767,442 | A * | 6/1998 | Eisenberg | H01B 7/0892 174/113 R |
| 5,956,445 | A * | 9/1999 | Deitz, Sr. | G02B 6/441 174/24 |
| 6,452,107 | B1 * | 9/2002 | Kebabjian | H01B 11/002 174/113 R |

(Continued)

*Primary Examiner* — William H Mayo, III

(57) ABSTRACT

A cable may include a plurality of twisted pairs of individually insulating electrical conductors, and a respective individual shield formed around each of the twisted pairs. Additionally, each individual shield may include electrically conductive material that is continuous in a longitudinal direction. An overall shield may be formed around the plurality of twisted pairs and individual shields. The overall shield may include a dielectric layer, a first layer of electrically conductive material that is continuous in the longitudinal direction formed on a first surface of the dielectric layer, and a second layer of electrically conductive material that is continuous in the longitudinal direction formed on a second surface of the dielectric layer opposite the first surface. The first and second layers of electrically conductive material and each of the individual shields may be in electrical contact with one another. Additionally, a jacket may be formed around the overall shield.

20 Claims, 6 Drawing Sheets

(56) References Cited

U.S. PATENT DOCUMENTS

| | | | | |
|---|---|---|---|---|
| 6,566,606 | B1 * | 5/2003 | Hazy | H01B 11/1091 174/113 R |
| 7,601,917 | B2 * | 10/2009 | Zamzow et al. | H01B 7/00 174/113 R |
| 8,039,749 | B2 * | 10/2011 | Okano | H01B 11/1008 174/113 R |
| 8,450,606 | B2 * | 5/2013 | McNutt | H01B 11/1008 174/36 |
| 8,859,902 | B2 * | 10/2014 | Matsuda | H01B 11/002 174/102 R |
| 9,136,044 | B2 * | 9/2015 | Lindstrom | H01B 11/1025 |
| 9,443,646 | B2 * | 9/2016 | Armbrecht et al. | H01B 11/005 174/102 R |
| 2001/0040042 | A1 * | 11/2001 | Stipes | H01B 11/02 174/113 R |
| 2005/0011664 | A1 * | 1/2005 | Lee | H02G 3/00 174/102 SC |
| 2006/0054334 | A1 * | 3/2006 | Vaupotic | H01B 11/1008 174/36 |
| 2013/0248221 | A1 * | 9/2013 | Booth | H01B 7/189 174/103 |

* cited by examiner

HIGH FREQUENCY SHIELDED COMMUNICATIONS CABLES

TECHNICAL FIELD

Embodiments of the disclosure relate generally to communications cables and, more particularly, to shielded communications cables that are capable of relatively high transmission rates.

BACKGROUND

A wide variety of different types of communications cables incorporate twisted pairs. In each pair, two conductors are twisted together in a helical fashion to form a balanced transmission line. A plurality of twisted pairs, such as four twisted pairs, are typically incorporated into a cable. A wide variety of factors, such as crosstalk, may affect the electrical performance of a cable and/or limit the maximum transmission rate of the cable. However, there is a desire to increase the transmission rate at which cables may transmit data.

A recent Category 8 cabling standard calls for twisted pair cables to be capable of transmitting data at frequencies greater than 600 MHz and up to 1.6 or even 2.0 GHz. In order to achieve these requirements, cables have been developed that utilize both individual twisted pair shields and outer shields in order to improve electrical performance. However, the outer or external shields formed around the collective plurality of pairs are typically formed as braided shields, such as tinned copper braid shields. The use of braided shields requires additional manufacturing steps and the use of specialized production equipment, thereby leading to a slower overall manufacturing process. Additionally, braided shields are typically formed from relatively expensive and heavy materials. Thus, the use of braided shields increases the weight and overall cost of twisted pair cables. Braided shields may also pose additional challenges to field technicians during cable installation and termination. Accordingly, there is an opportunity for improved communication cables capable of transmitting signals at relatively high frequencies, such as frequencies greater than 600 MHz.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items; however, various embodiments may utilize elements and/or components other than those illustrated in the figures. Additionally, the drawings are provided to illustrate example embodiments described herein and are not intended to limit the scope of the disclosure.

DETAILED DESCRIPTION

Figure 1:
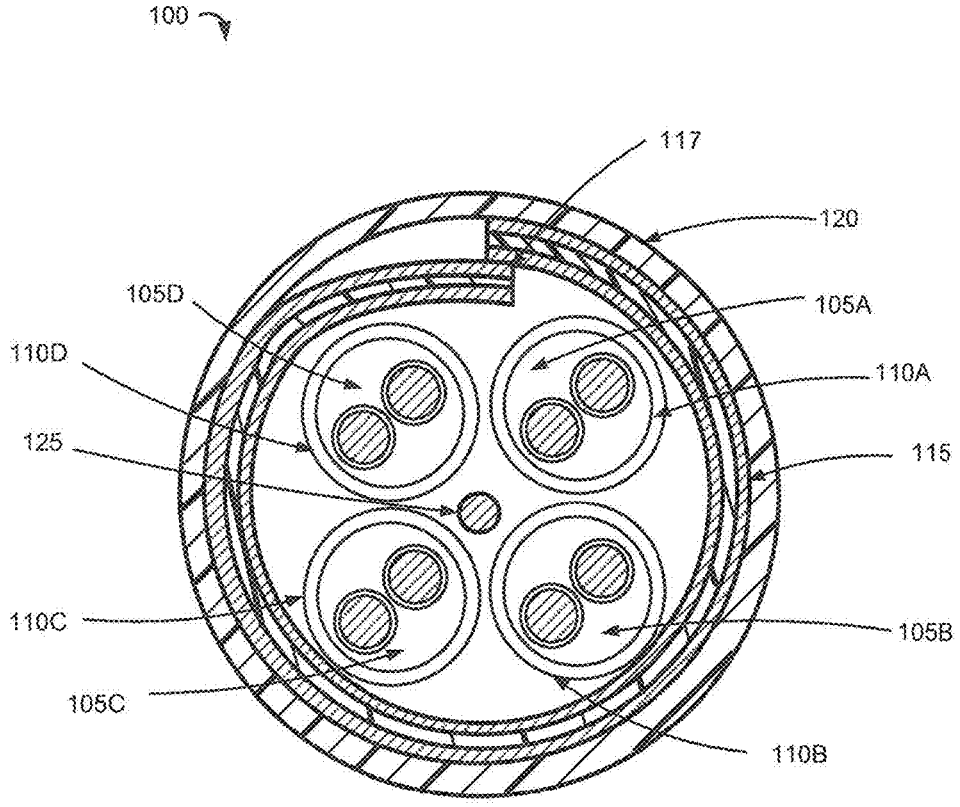
FIGS. 1-3 illustrate cross-sectional views of example shielded communication cables, according to an illustrative embodiment of the disclosure.

Various embodiments of the present disclosure are directed to twisted pair communication cables capable of relatively high frequency data transmission, such as transmission at frequencies greater than approximately 600 MHz. In certain embodiments, a cable may include a plurality of twisted pairs of individually insulated conductors that each extend in a longitudinal direction. A respective individual shield layer containing longitudinally continuous electrically conductive material may be formed around each of the twisted pairs. Additionally, an overall shield may be formed around the plurality of individually shielded twisted pairs. The overall shield may include a substrate layer and two longitudinally continuous layers of electrically conductive material formed on opposite sides or surfaces of the substrate layer. In other words, three separate layers of shielding material may be formed around each of the twisted pairs. Additionally, the various layers of shielding material may all be electrically shorted together or in electrical contact with one another. A jacket may then be formed around the twisted pairs and the shield layers.

Shield layers may be formed from a wide variety of suitable materials and/or combinations of materials. Additionally, shield layers may be formed with any number of suitable layers. For example, an individual shield layer may be formed from a single layer of continuous electrically conductive material, such as a metallic foil. As another example, an individual shield layer may include a layer of dielectric material (e.g., polypropylene, polyethylene, etc.) and a layer of electrically conductive material (e.g., a metallic foil layer, etc.) formed on the dielectric material. As set forth above, an overall shield may include at least one layer of dielectric material and two layers of electrically conductive material. For example, an overall shield may include two metallic foil layers formed on opposite sides of a dielectric layer.

A wide variety of suitable techniques may be utilized as desired in order to electrically short the two layers of electrically conductive material of an overall shield. For example, an overlap may be formed at or near a widthwise edge of the overall shield when it is wrapped or curled around the twisted pairs, and the two electrically conductive layers may be shorted to one another at the overlap. As another example, gaps and/or electrically conductive vias may be formed through the dielectric layer. As yet another example, at least one of the electrically conductive layers may extend beyond a longitudinally extending widthwise edge of the dielectric layer such that the two electrically conductive layers may be brought into contact with one another.

Additionally, as desired in certain embodiments, one or more drain wires may be incorporated into the cable. A drain wire may be in contact with one of the electrically conductive layers and, therefore, the drain wire may be in electrical contact with all of the electrically conductive layers (e.g., all of the individual shield layers and both electrically conductive layers of the overall shield). A drain wire may be positioned in a wide variety of locations within a cable. For example, a drain wire may be positioned between the plurality of twisted pairs, between one of the twisted pairs and the overall shield, or between two layers of the overall shield. In certain embodiments, a drain wire may be grounded when the cable is terminated in order to reduce electrical shock hazards. In other embodiments, at least one of the longitudinally continuous shielding layers may be grounded when the cable is terminated. For example, the overall shield may be grounded to a connector.

As a result of incorporating a combination of electrically shorted individual shielding layers and an overall shield having at least two electrically conductive layers, a relatively high frequency twisted pair capable may be obtained. For example, a cable may be capable of transmission frequencies of at least approximately 600 MHz and, in some cases, transmission frequencies of up to approximately 2 GHz or greater. These transmission frequencies may permit a cable to operate as a Category 8 cable as defined by applicable standards. Additionally, the use of relatively thin shielding layers, such as metallic foil shielding layers, may provide greater flexibility and/or may permit more efficient and/or less costly production of a cable relative to conventional cables that incorporate braided overall shields. In certain embodiments, a cable may be produced with a lighter overall weight than conventional cables incorporating braided shields.

Embodiments of the disclosure now will be described more fully hereinafter with reference to the accompanying drawings, in which certain embodiments of the disclosure are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 2:
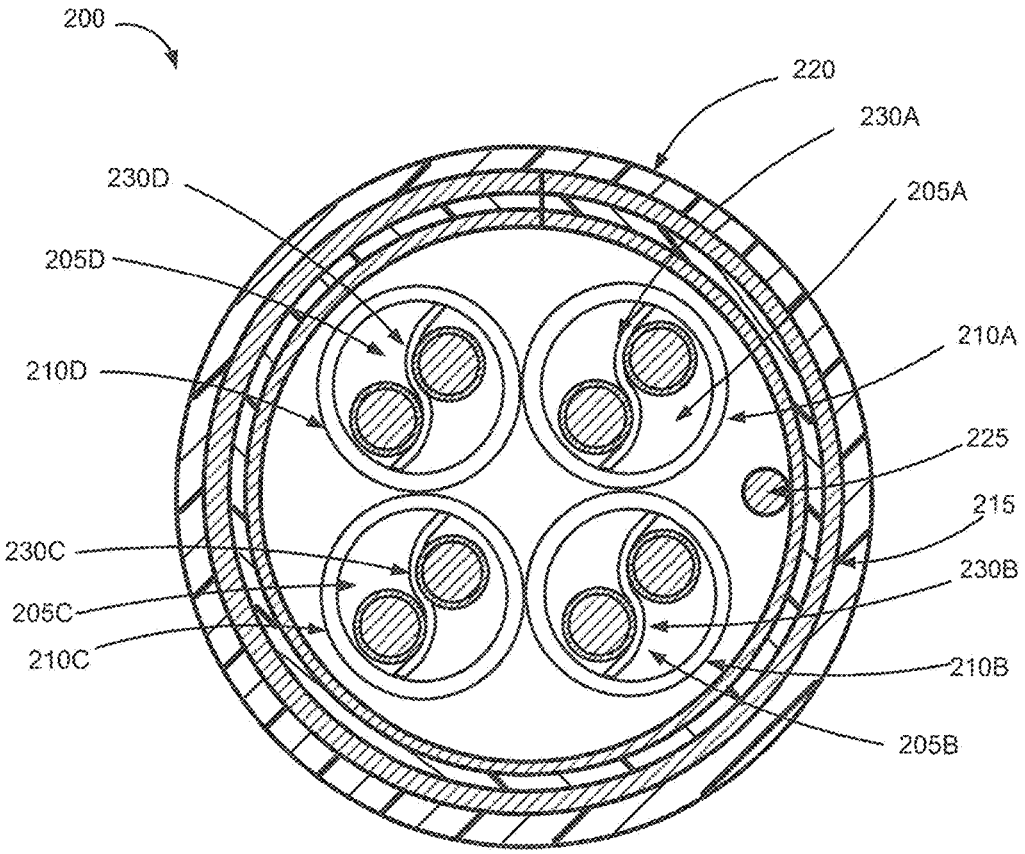
Figure 3:
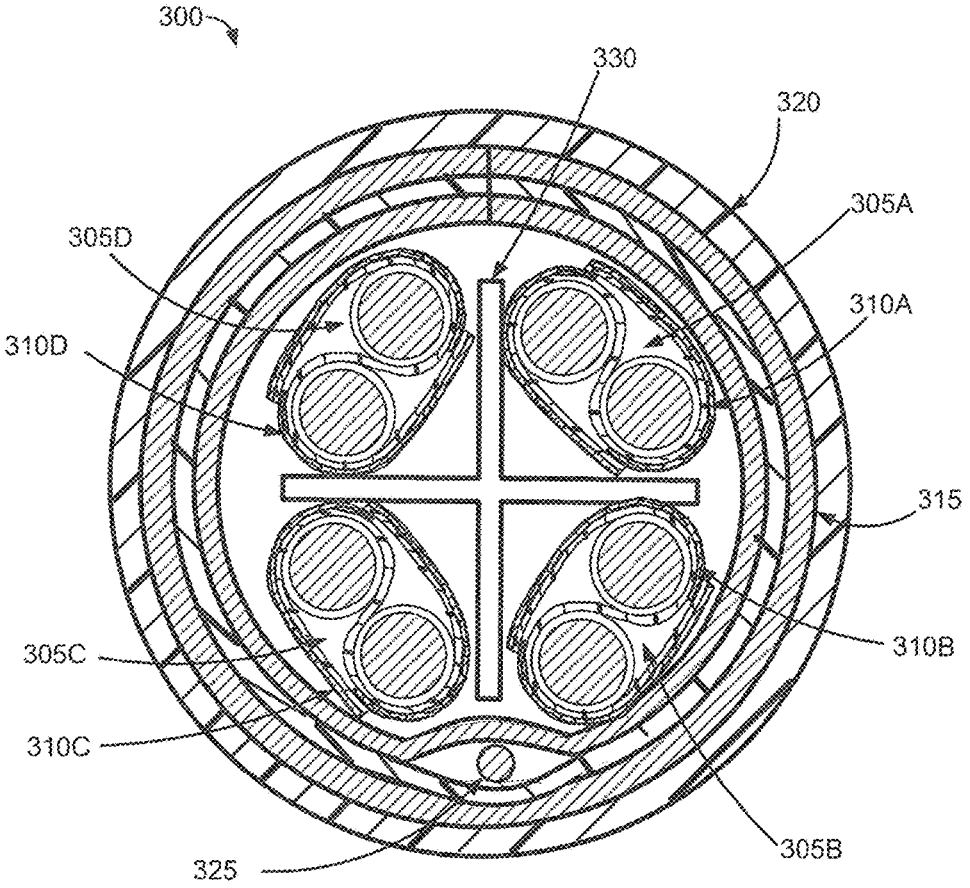

FIGS. 1-3 illustrate cross-sectional views of example shielded communication cables that may be formed in accordance with various embodiments of the disclosure. Each of the cables illustrated in FIGS. 1-3 may include a plurality of individually shielded twisted pairs and an overall shield that includes at least two layers of electrically conductive material. As such, certain components of the cables may be similar. Additionally, it will be appreciated that various components, features, and/or aspects of the cables may be interchangeable and/or incorporated into a wide variety of other suitable cable designs. Indeed, the illustrated cables are provided by way of non-limiting example only.

Turning first to FIG. 1, a cross-sectional view of a first example cable 100 is illustrated. The cable 100 may include a plurality of twisted pairs 105A-D, individual shields 110A-D respectively formed around each of the twisted pairs 105A-D, an overall shield 115 formed around the plurality of twisted pairs 105A-D, and a jacket 120 formed around the overall shield 115. The cable 100 is illustrated as a twisted pair communications cable; however, other types of cables may be utilized, such as composite or hybrid cables that include a combination of twisted pairs and other transmission media (e.g., optical fibers, etc.). Indeed, suitable cables may include any number of transmission media including but not limited to one or more twisted pairs, optical fibers, coaxial cables, and/or power conductors. Additionally, embodiments of the disclosure may be utilized in association with horizontal cables, vertical cables, flexible cables, equipment cords, cross-connect cords, plenum cables, riser cables, or any other appropriate cables.

Although four twisted pairs 105A, 105B, 105C, 105D are illustrated in FIG. 1, any other suitable number of pairs may be utilized. As desired, the twisted pairs 105A-D may be twisted or bundled together and/or suitable bindings may be wrapped around the twisted pairs 105A-D. In other embodiments, multiple grouping of twisted pairs may be incorporated into a cable, and any of the groupings may include a respective separator. Additionally, as desired, the multiple groupings may be twisted, bundled, or bound together.

Each twisted pair (referred to generally as twisted pair 105) may include two electrical conductors, each covered with suitable insulation. Each twisted pair 105 can carry data or some other form of information at any desirable frequency, such as a frequency that permits the overall cable 100 to carry data at approximately 600 MHz or greater. As desired, each of the twisted pairs may have the same twist lay length or alternatively, at least two of the twisted pairs may include a different twist lay length. For example, each twisted pair may have a different twist rate. The different twist lay lengths may function to reduce crosstalk between the twisted pairs. A wide variety of suitable twist lay length configurations may be utilized. In certain embodiments, the differences between twist rates of twisted pairs that are circumferentially adjacent one another (for example the twisted pair 105A and the twisted pair 105B) may be greater than the differences between twist rates of twisted pairs that are diagonal from one another (for example the twisted pair 105A and the twisted pair 105C). As a result of having similar twist rates, the twisted pairs that are diagonally disposed can be more susceptible to crosstalk issues than the twisted pairs 105 that are circumferentially adjacent; however, the distance between the diagonally disposed pairs may limit the crosstalk.

Additionally, in certain embodiments, each of the twisted pairs 105A-D may be twisted in the same direction (e.g., clockwise, counter clockwise). In other embodiments, at least two of the twisted pairs 105A-D may be twisted in opposite directions. Further, as desired in various embodiments, one or more of the twisted pairs 105A-D may be twisted in the same direction as an overall bunch lay of the combined twisted pairs. For example, the conductors of each of the twisted pairs 105A-D may be twisted together in a given direction. The plurality of twisted pairs 105A-D may then be twisted together in the same direction as each of the individual pair's conductors. In other embodiments, at least one of the twisted pairs 105A-D may have a pair twist direction that is opposite that of the overall bunch lay. For example, all of the twisted pairs 105A-D may have pair twist directions that are opposite that of the overall bunch lay.

The electrical conductors of a twisted pair 105 may be formed from any suitable electrically conductive material, such as copper, aluminum, silver, annealed copper, copper clad aluminum, gold, a conductive alloy, etc. Additionally, the electrical conductors may have any suitable diameter, gauge, cross-sectional shape (e.g., approximately circular, etc.) and/or other dimensions. Further, each of the electrical conductors may be formed as either a solid conductor or as a conductor that includes a plurality of conductive strands that are twisted together.

The twisted pair insulation may include any suitable dielectric materials and/or combination of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. Additionally, in certain embodiments, the insulation of each of the electrical conductors utilized in the twisted pairs 105A-D may be formed from similar materials. In other embodiments, at least two of the twisted pairs may utilize different insulation materials. For example, a first twisted pair may utilize an FEP insulation while a second twisted pair utilizes a non-FEP polymeric insulation. In yet other embodiments, the two conductors that make up a twisted pair 105 may utilize different insulation materials.

In certain embodiments, the insulation may be formed from multiple layers of one or a plurality of suitable materials. In other embodiments, the insulation may be formed from one or more layers of foamed material. As desired, different foaming levels may be utilized for different twisted pairs in accordance with twist lay length to result in insulated twisted pairs having an equivalent or approximately equivalent overall diameter. In certain embodiments, the different foaming levels may also assist in balancing propagation delays between the twisted pairs. As desired, the insulation may additionally include other materials, such as a flame retardant materials, smoke suppressant materials, etc.

According to an aspect of the disclosure, an individual shield layer may be formed around each of the twisted pairs 105A-D. For example, as shown in FIG. 1, a first individual shield 110A may be formed around a first twisted pair 105A, a second individual shield 110B may be formed around a second twisted pair 105B, a third individual shield 110C may be formed around a third twisted pair 105C, and a fourth individual shield 110D may be formed around a fourth twisted pair 105D. Each of the individual shields 100A-D may be wrapped or curled around an associated twisted pair 105A-D along a longitudinal length of the cable 100.

Although FIG. 1 illustrates individual shield layers that are respectively wrapped around respective twisted pairs, a wide variety of other suitable methods and/or techniques may be utilized to form individual shields. For example, as discussed in greater detail below with reference to FIG. 3, a respective dielectric separator structure may be utilized in association with each twisted pair. A dielectric separator structure may include a first portion that is positioned between the conductors of a twisted pair and at least one second portion including shielding material that is wrapped around an outer periphery of the twisted pair. Additional examples of combination dielectric separator/shield structures are described in U.S. patent application Ser. No. 14/742,147, filed Jun. 17, 2015 and entitled "Communication Cables Incorporating Twisted Pair Separators That Function as Shields", the entire contents of which are incorporated by reference herein. As another example, a separator structure or separator may be positioned between the plurality of twisted pairs, and the separator may include at least one portion that extends beyond an outer periphery of the twisted pairs and that is wrapped around the outer periphery. Both a portion of the separator positioned between the pairs and the one or more extending portions that are wrapped around the pairs may include shielding material and, therefore, the separator may form individual shields for each of the pairs. As yet another example, shielding material may be incorporated into a separator (e.g., a cross filler, etc.) positioned between the twisted pairs, and a separate shield layer may be formed around the plurality of twisted pairs. The combination of the separator and the shield layer may function as individual shields for each of the pairs. A wide variety of other components and/or techniques may be utilized as desired to provide individual pair shields, and those described above are provided by way of non-limiting example only.

Regardless of the technique utilized to form individual shields 110A-D, each individual shield (generally referred to as individual shield 110 or shield 110) may be formed with any number of suitable layers and from a wide variety of suitable materials and/or combinations of materials. In certain embodiments, an individual shield 110 may be formed as a single layer foil shield that includes a single layer of metallic or other suitable shielding material. In other embodiments, an individual shield 110 may be formed from a plurality of layers of shielding material. For example, a plurality of foil layers may be stacked and optionally adhered, bonded, welded, mechanically fastened, or otherwise attached to one another.

In other embodiments, an individual shield may be formed from a combination of dielectric material and shielding material. For example, the shield 110 may be formed as a tape that includes both a dielectric layer and at least one shielding layer. As one example, a base dielectric material may be extruded, poltruded, or otherwise formed. Electrically conductive material or other shielding material may then be applied to the base material. For example, a metallic foil may be applied to a base dielectric layer. In certain embodiments, a base layer and shielding layer may be bonded, adhered, or otherwise joined together to form a shield 110. In other embodiments, shielding material may be formed on a dielectric layer via any number of suitable techniques, such as the application of metallic ink or paint, liquid metal deposition, vapor deposition, welding, heat fusion, etc. As desired, shielding material may be formed on both sides of a dielectric layer. A few non-limiting example layer constructions for individual shields are described in greater detail below with reference to FIGS. 4A-4B.

In certain embodiments, a dielectric layer of a shield 110 may have a substantially uniform composition and/or may be made of a wide range of materials. Additionally, the dielectric layer may be fabricated in any number of manufacturing passes, such as a single manufacturing pass. Further, the dielectric layer may be foamed, may be a composite, and/or may include one or more strength members, fibers, threads, or yarns. As desired, flame retardant material, smoke suppressants, and/or other desired substances may be blended or incorporated into the dielectric layer. Examples of suitable materials that may be used to form a base or other dielectric layer include, but are not limited to, various plastics, one or more polymeric materials, one or more polyolefins (e.g., polyethylene, polypropylene, etc.), one or more fluoropolymers (e.g., fluorinated ethylene propylene ("FEP"), polyester, polytetrafluoroethylene, polyimide, or some other polymer, combination of polymers, or dielectric material(s) that does not ordinarily conduct electricity.

A wide variety of suitable materials and/or combinations of materials may be utilized to form a shielding layer of an individual shield 110. In certain embodiments, one or more electrically conductive materials may be utilized including, but not limited to, metallic material (e.g., silver, copper, nickel, steel, iron, annealed copper, gold, aluminum, etc.), metallic alloys, conductive composite materials, etc. For example, a metallic foil (e.g., aluminum foil, etc.) may be utilized to form a shielding layer. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. In other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc.

The components of an individual shield 110 may include a wide variety of suitable dimensions, for example, any suitable lengths in the longitudinal direction, widths (i.e., a distance of the shield that will be wrapped around a twisted pair 105) and/or any suitable thicknesses. For example, the dielectric or base portion of a shield 110 may have a thickness of about 1 to about 5 mils (thousandths of an inch) or about 25 to about 125 microns. Additionally, each the shielding material may have any desired thickness, such as a thickness of about 0.5 mils (about 13 microns) or greater. In many applications, signal performance may benefit from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils. Indeed, a thickness of greater than about 1.5 mils may reduce or limit negative insertion loss characteristics.

According to an aspect of the disclosure, each individual shield 110 may be formed as continuous shield. In other words, a shielding layer (e.g., a metallic foil layer, etc.) may be continuous along a longitudinal length of the shield 110 and/or the cable. Additionally, each individual shield 110 may be formed around a respective twisted pair 105 such that a shielding layer faces away from the twisted pair. In other words, the shielding layer may be formed on an outer surface of the shield 110. In this regard, the shielding layer may be in electrical contact with other shielding layers incorporated into the cable 100, such as adjacent individual shields and the overall shield 115.

A wide variety of suitable methods and/or techniques may be utilized to form an individual shield 110 around a twisted pair 105. For example, the individual shield 110 may be fed or otherwise provided from a suitable source, such as a bin, spool, or reel during a cable assembly process. The individual shield 110 may be positioned near or brought into proximity with a twisted pair 105, such as a twisted pair 105 provided from a suitable source (e.g., a reel, etc.) or fed from an upstream assembly process. The individual shield 110 may then be curled at one or both of its longitudinally extending widthwise edges such that is wrapped around the twisted pair 105. For example, the individual shield 110 may be fed through one or more suitable dies that operate to curl or wrap the shield 110. Once wrapped, in certain embodiments, at least one widthwise edge of the shield 110 may overlap another portion of the shield 110, such as the opposite widthwise edge (or another portion if a relatively substantial overlap is formed). As desired, the shield 110 may be bonded, fastened, or otherwise affixed to itself within the overlapping portion or region. For example, an overlapping portion may be adhered, ultrasonically welded, mechanically fastened, or otherwise affixed to an underlying portion of the individual shield 110.

With continued reference to FIG. 1, an overall shield 115 may be formed around the plurality of individually shielded twisted pairs 105A-D. For example, an overall shield 115 may be formed around the plurality of individual shield layers 110A-D. According to an aspect of the disclosure, the overall shield 115 may be formed from a combination of dielectric material and shielding material. The overall shield 115 may include at least one dielectric layer and at least two layers of shielding material, such as a respective layer of shielding material formed on each surface or side of the dielectric layer. In other words, the overall shield 115 may include at least two separate shielding layers, such as two metallic foil shielding layers. A few non-limiting examples of layer constructions that may be utilized to form an overall shield are described in greater detail below with reference to FIGS. 5A-5B.

In certain embodiments, the overall shield 115 may be formed as a suitable tape that may be curled or wrapped around the plurality of twisted pairs 105A-D. For example, a base dielectric material may be extruded, poltruded, or otherwise formed. Electrically conductive material or other shielding material may then be applied to the base material. For example, a respective metallic foil may be applied to each side of a base dielectric layer. In certain embodiments, a base layer and one or more shielding layers may be bonded, adhered, or otherwise joined together to form an overall shield 115. In other embodiments, shielding material may be formed on a dielectric layer via any number of suitable techniques, such as the application of metallic ink or paint, liquid metal deposition, vapor deposition, welding, heat fusion, etc.

Although a single dielectric layer is illustrates in FIG. 1, an overall shield 115 may be formed with any number of dielectric layers. In certain embodiments, a dielectric layer of the overall shield 115 may have a substantially uniform composition and/or may be made of a wide range of materials. Additionally, a dielectric layer may be fabricated in any number of manufacturing passes, such as a single manufacturing pass. As desired, a dielectric layer may be foamed, may be a composite, and/or may include one or more strength members, fibers, threads, or yarns. In certain embodiments, flame retardant material, smoke suppressants, and/or other desired substances may be blended or incorporated into a dielectric layer. Examples of suitable materials that may be used to form a base or other dielectric layer include, but are not limited to, various plastics, one or more polymeric materials, one or more polyolefins (e.g., polyethylene, polypropylene, etc.), one or more fluoropolymers (e.g., fluorinated ethylene propylene ("FEP"), polyester, polytetrafluoroethylene, polyimide, or some other polymer, combination of polymers, or dielectric material(s) that does not ordinarily conduct electricity.

A wide variety of suitable materials and/or combinations of materials may be utilized to form a shielding layer of the overall shield 115. In certain embodiments, one or more electrically conductive materials may be utilized including, but not limited to, metallic material (e.g., silver, copper, nickel, steel, iron, annealed copper, gold, aluminum, etc.), metallic alloys, conductive composite materials, etc. For example, a metallic foil (e.g., aluminum foil, etc.) may be utilized to form a shielding layer. Indeed, suitable electrically conductive materials may include any material having an electrical resistivity of less than approximately $1\times10^{-7}$ ohm meters at approximately 20° C. In certain embodiments, an electrically conductive material may have an electrical resistivity of less than approximately $3\times10^{-8}$ ohm meters at approximately 20° C. in other embodiments, one or more semi-conductive materials may be utilized including, but not limited to, silicon, germanium, other elemental semiconductors, compound semiconductors, materials embedded with conductive particles, etc. In yet other embodiments, one or more dielectric shielding materials may be utilized including, but not limited to, barium ferrite, etc.

The components of the overall shield 115 may include a wide variety of suitable dimensions, for example, any suitable lengths in the longitudinal direction, widths (i.e., a distance of the shield 115 that will be wrapped around the twisted pairs 105A-D) and/or any suitable thicknesses. For example, the dielectric or base portion of the overall shield 115 may have a thickness of about 1 to about 5 mils (thousandths of an inch) or about 25 to about 125 microns. Additionally, each layer shielding material may have any desired thickness, such as a thickness of about 0.5 mils (about 13 microns) or greater. In many applications, signal performance may benefit from a thickness that is greater than about 2 mils, for example in a range of about 2.0 to about 2.5 mils, about 2.0 to about 2.25 mils, about 2.25 to about 2.5 mils, about 2.5 to about 3.0 mils, or about 2.0 to about 3.0 mils. Indeed, a thickness of greater than about 1.5 mils may reduce or limit negative insertion loss characteristics.

According to an aspect of the disclosure, each shielding layer of the overall shield 115 may be formed as continuous shield. In other words, each shielding layer (e.g., a metallic foil layer, etc.) may be continuous along a longitudinal length of the overall shield 115 and/or the cable. Additionally, according to an aspect of the disclosure, the two shielding layers may be electrically bonded to or in electrical contact with one another. A wide variety of suitable methods and/or techniques may be utilized to form an electrical connection between the two shielding layers. For example, as illustrated in FIG. 1, an overlap 117 may be formed when the overall shield 115 is wrapped around the twisted pairs 105A-D. Any amount of overlap may be formed as desired. As a result of the overlap 117, a first shielding layer (e.g., a top or outermost layer) of the shield 115 may be brought into contact with an overlapping second shielding layer (e.g., a bottom or innermost layer) of the shield 115. As another example, gaps or spaces may be formed through the dielectric layer in order to permit the two shielding layers to come into contact with one another. As yet another example, electrically conductive vias may be formed through the dielectric layer. As yet another example, at least one of the shielding layers may extend beyond a longitudinally extending widthwise edge of the dielectric layer at any number of locations (e.g., in a continuous manner, at longitudinally spaced locations, etc.) to facilitate contact between the shielding layers. A few non-limiting examples of techniques for electrically bonding the two shielding layers together are described in greater detail below with reference to FIGS. 6A-6C.

A wide variety of suitable methods and/or techniques may be utilized to form an overall shield 115 around the plurality of twisted pairs 105A-D. For example, the overall shield 115 may be fed or otherwise provided from a suitable source, such as a bin, spool, or reel during a cable assembly process. The shield 115 may be positioned near or brought into proximity with the twisted pairs 105A-D, for example, after the twisted pairs 105A-D are bunched and/or helically twisted together with an overall twist. The overall shield 115 may then be curled at one or both of its longitudinally extending widthwise edges such that is wrapped around the twisted pairs 105A-D. For example, the overall shield 115 may be fed through one or more suitable dies that operate to curl or wrap the shield 115. Once wrapped, in certain embodiments, at least one widthwise edge of the shield 115 may overlap another portion of the shield 115, such as the opposite widthwise edge (or another portion if a relatively substantial overlap is formed). As desired, the shield 115 may be bonded, fastened, or otherwise affixed to itself within the overlapping portion or region. For example, an overlapping portion may be adhered, ultrasonically welded, mechanically fastened, or otherwise affixed to an underlying portion of the overall shield 115.

According to an aspect of the disclosure, at least three shielding layers may be formed around each of the twisted pairs 105A-D. For example, as shown in FIG. 1, individual shields 110A-D may be respectively formed around each of the twisted pairs 105A-D. Additionally, an overall shield 115 that includes at least two shielding layers may be formed around the plurality of twisted pairs 105A-D. In certain embodiments, the triple shielding structure may provide adequate shielding to facilitate the cable 100 satisfying or exceeding the electrical performance requirements established for Category 8 cables, such as the requirements set forth in ISO/IEC TR 11801-99-1 and ANSI/TIA-568-C.2-1 as promulgated by the International Organization for Standardization ("ISO"), the International Electrotechnical Commission ("IEC"), the American National Standards Institute ("ANSI"), and/or the Telecommunications Industry Association ("TIA"). A wide variety of other suitable Category 8 and/or other standards may also be satisfied. In certain embodiments, the combination of shield structures may permit the cable 100 to operate at frequencies of approximately 600 MHz or greater. In other embodiments, the cable 100 may operate at frequencies of up to approximately 2 GHz or greater, such as frequencies between approximately 600 MHz and approximately 2 GHz. In various embodiments, the cable 100 may operate at frequencies of approximately 600 MHz, 700 MHz, 800 MHz, 900 MHz, 1.0 GHz, 1.1 GHz, 1.2 GHz, 1.3 GHz, 1.4 GHz, 1.5 GHz, 1.6 GHz, 1.7 GHz, 1.8 GHz, 1.9 GHz, 2.0 GHz, a frequencies included in a range between any two of the above values, or a frequency included in a range bounded on either a minimum or maximum end by one of the above values.

In certain embodiments, the combination of shield structures or shielding layers may provide similar or better performance than a conventional braided shield, such as a conventional tinned copper braid shields. As a result, the cable may be produced in a more efficient and/or less costly fashion. Indeed, the integration of a braided shield into a cable often requires additional manufacturing operations and the use of specialized or specific production equipment. The integration of a braided shield may also result in a relatively longer manufacturing process, thereby reducing cable output (e.g., line speed, etc.) and increasing production cost. Use of a braided shield may also increase the overall weight of a cable, which may lead to increased transportation/shipping cost and/or increased installation/pulling difficulty. Additionally, a braided shield may be more difficult for a technician to cut or handle during cable installation and/or termination.

According to an aspect of the disclosure, each of the shielding layers of the cable 100 may be electrically bonded to one another or in electrical contact with one another. For example, as set forth above, each of the individual shields 110A-D may have an outer layer of shielding material. Accordingly, the individual shields 110A-D may be in electrical contact with one another and with the overall shield 115. Additionally, because the two shielding layers of the overall shield 115 are in electrical contact with one another, all of the various shielding layers may be in electrical contact. In certain embodiments, electrically bonding the shielding layers to one another may enhance or improve the shielding efficiency of the various shielding layers and/or the combined shielding layers. The bonded shielding layers may limit electrical leakages, reduce coupling attenuation, and/or limit crosstalk. Additionally, bonded shielding layers may provide for easier grounding at termination. In the event that one of the shielding layers is grounded at termination (e.g., grounded at a connector, grounded via connection to a grounded drain wire, etc.), then all of the shielding layers may be grounded as a result of their electrical connections to one another.

In certain embodiments, a cable 100 that utilizes a combination of continuous shielding layers as opposed to a braided shield may be formed with a relatively lighter overall weight. For a normalized width of approximately one inch, a braided shield typically has a weight between approximately 4.5 pounds and approximately 6.5 pounds per 1000 feet of length. By contrast, an overall shield 115 formed in accordance with the present disclosure and with a normalized width of approximately one inch may have a weight between approximately 1.5 pounds and approximately 3.0 pounds per 1000 feet of length. As a result, incorporation of the overall shield may result in a weight reduction in the cable 100 of up to approximately 10.0% relative to conventional cables utilizing a braided shield.

Additionally, in certain embodiments, the use of a plurality of continuous shield layers that are in electrical contact with one another may provide for or facilitate improved heat dissipation within a cable 100. For example, in many conventional cables, power transmitted through the conductors and the resistance of the conductors may result in an increase in cable temperature which may reduce electrical performance. The use of the continuous shield layers discussed herein may provide for improve heat conduction within the cable and may draw heat away from the twisted pairs 105A-D. Additionally, the continuous shield layers may promote heat dissipation and/or temperature normalization along a longitudinal length of the cable 100. As a result, improved electrical performance may be obtained. In certain applications, such as power over Ethernet ("POE") applications, the enhanced heat dissipation may permit or facilitate an increased amperage rating.

With continued reference to FIG. 1, the jacket 120 may enclose the internal components of the cable 100, seal the cable 100 from the environment, and provide strength and structural support. The jacket 120 may be formed from a wide variety of suitable materials and/or combinations of materials, such as one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, cholorosulphonated polyethylene, flame retardant PVC, low temperature oil resistant PVC, flame retardant polyurethane, flexible PVC, or a combination of any of the above materials. The jacket 120 may be formed as a single layer or, alternatively, as multiple layers. In certain embodiments, the jacket 120 may be formed from one or more layers of foamed material. As desired, the jacket 120 can include flame retardant and/or smoke suppressant materials. Additionally, the jacket 120 may include a wide variety of suitable shapes and/or dimensions. For example, the jacket 120 may be formed to result in a round cable or a cable having an approximately circular cross-section; however, the jacket 120 and internal components may be formed to result in other desired shapes, such as an elliptical, oval, or rectangular shape. The jacket 120 may also have a wide variety of dimensions, such as any suitable or desirable outer diameter and/or any suitable or desirable wall thickness. In various embodiments, the jacket 120 can be characterized as an outer jacket, an outer sheath, a casing, a circumferential cover, or a shell.

An opening enclosed by the jacket 120 may be referred to as a cable core, and the twisted pairs 105A-D and shields 110A-D, 115 may be disposed within the cable core. Although a single cable core is illustrated in FIG. 1, a cable may be formed to include multiple cable cores. In certain embodiments, a cable core may be filled with a gas such as air (as illustrated) or alternatively a gel, solid, powder, moisture absorbing material, water-swellable substance, dry filling compound, or foam material, for example in interstitial spaces between the individually shielded twisted pairs 105A-D. Other elements can be added to the cable core as desired, for example one or more optical fibers, additional electrical conductors, additional twisted pairs, water absorbing materials, and/or strength members, depending upon application goals.

In certain embodiments, one or more adhesives may be incorporated into the cable 100. For example, an adhesive layer may be applied onto an outer shielding layer of the overall shield 115. A wide variety of suitable adhesives may be utilized as desired in various embodiments to form the adhesive layer including, but not limited to, contact adhesives, thermoset adhesives, thermoplastic adhesives, cationic curable adhesives, UV curable adhesives, epoxy, etc. In certain embodiments, a self-lubricating adhesive layer may be formed. For example, the overall shield 115 may be formed with a self-lubricating adhesive layer that is covered by a removable tape or film. During cable assembly, the tape or film may be removed in order to expose the adhesive. In certain embodiments, the adhesive layer may facilitate the formation of a bond between the overall shield 115 and the jacket 120.

With continued reference to FIG. 1, in certain embodiments, one or more drain wires may be incorporated into the cable 100. For example, as illustrated in FIG. 1, a drain wire 125 may be positioned between the individually shielded twisted pairs 105A-D. As another example, as illustrated in FIG. 2, a drain wire may be positioned between one or more of the individually shielded twisted pairs 105A-D and the overall shield 115. As yet another example, as illustrated in FIG. 3, a drain wire may be positioned between two layers of the overall shield 115, such as between a dielectric layer and either the inner or the outer shielding layer. Although single drain wires are illustrated in FIG. 1, a plurality of drain wires may be utilized as desired in other embodiments, and each drain wire may be positioned at any desired location within the cable 100 such that is contacts at least one of the shielding layers. Additionally, a drain wire 125 may be formed from a wide variety of suitable materials and/or combinations of materials, such as tinned copper, copper, aluminum, conductive alloys, or other conductive materials. A drain wire 125 may also be formed with a wide variety of suitable dimensions (e.g., gauge, diameter, cross-sectional area, etc.) and/or cross-sectional shapes. For example, a drain wire 125 may be formed as a round wire having an American Wire Gauge ("AWG") between approximately 22 and approximately 24. As another example, a drain wire 125 may be formed with a diameter between approximately 0.0191 inches and approximately 0.0271 inches. In various embodiments, a drain wire 125 may be formed as either a solid conductor or from a plurality of stranded conductors.

As desired in various embodiments, a wide variety of other materials may be incorporated into the cable 100 of FIG. 1. For example, the cable 100 may include any number of conductors, twisted pairs, optical fibers, and/or other transmission media. As another example, as shown in FIG. 2, one or more respective dielectric films or other suitable components may be positioned between the individual conductors of one or more of the twisted pairs 105A-D. As yet another example, as shown in FIG. 3, a suitable separator or filler may be positioned between at least two of the twisted pairs. Additionally, as desired, a cable may include a wide variety of strength members, swellable materials (e.g., aramid yarns, blown swellable fibers, etc.), insulating materials, dielectric materials, flame retardants, flame suppressants or extinguishants, gels, and/or other materials. The cable 100 illustrated in FIG. 1 is provided by way of example only. Embodiments of the disclosure contemplate a wide variety of other cables and cable constructions. These other cables may include more or less components than the cable 100 illustrated in FIG. 1. Additionally, certain components may have different dimensions and/or materials than the components illustrated in FIG. 1. Additionally, although FIG. 1 illustrates a jacketed cable, an unjacketed twisted pair component including individually shielded pairs and an overall shield may be incorporated into a larger cable structure.

FIG. 2 illustrates a cross-sectional of another example shielded communications cable 200. The cable 200 may include components that are similar to those described above with reference to the cable 100 of FIG. 1. For example, the cable 200 may include a plurality of twisted pairs 205A-D, individual shields 210A-D respectively formed around each of the twisted pairs 205A-D, an overall shield 215 formed around the plurality of twisted pairs 205A-D, and a jacket 220 formed around the overall shield 215. Additionally, one or more drain wires 225 may be incorporated into the cable 200.

With continued reference to FIG. 2, in certain embodiments, respective dielectric separators 230A-D may be woven helically between the individual conductors or conductive elements of one or more of the twisted pairs 205A-D. In other words, a dielectric separator (generally referred to as dielectric separator 235) may be helically twisted with the conductors of a twisted pair 205 along a longitudinal length of the cable 200. In certain embodiments, the dielectric separator 235 may maintain spacing between the individual conductors of the twisted pair 205 and/or maintain the positions of one or both of the individual conductors. For example, the dielectric separator 235 may be formed with a cross-section (e.g., an X-shaped cross-section, an H-shaped cross-section, etc.) that assists in maintaining the position(s) of one or both the individual conductors of the twisted pair 205. In other words, the dielectric separator 235 may reduce or limit the ability of one or both of the individual conductors to shift, slide, or otherwise move in the event that certain forces, such as compressive forces, are exerted on the cable 200. As illustrated in FIG. 2, in other embodiments, a dielectric separator 235 may be formed as a relatively simple film layer that is positioned between the individual conductors of a twisted pair 205.

Additionally, in contrast to FIG. 1, FIG. 2 illustrates an overall shield 215 that does not overlap itself at or near one of its longitudinally extending widthwise edges. As set forth above, a wide variety of other suitable methods and/or techniques may be utilized in order to electrically short the two shielding layers of the overall shield 215 together. For example, gaps or spaces may be formed through the dielectric layer such that the two shielding layers may contact one another. As another example, one or more of the shielding layers may extend beyond the dielectric layer (e.g., at one or more locations along a widthwise edge, etc.) such that the two shielding layers may contact one another. With reference to FIG. 2, gaps, spaces, or electrically conductive vias may be formed through the dielectric layer in order to facilitate contact between the two shielding layers.

With additional reference to FIG. 2, a drain wire 225 may be positioned between one or more of the individually shielded twisted pairs 205A-D and the overall shield 215. Indeed, as set forth in greater detail above, one or more drain wires may be positioned in a wide variety of suitable locations within a cable 200. Because each of the shielding layers within the cable 200 may be electrically shorted to one another, a drain wire in contact with any of the shielding layers may be in contact with all of the shieldi FIG. 3 illustrates a cross-sectional of another example shielded communications cable 300. The cable 300 may include components that are similar to those described above with reference to the cables 100, 200 of FIGS. 1-2. For example, the cable 300 may include a plurality of twisted pairs 305A-D, individual shields 310A-D respectively formed around each of the twisted pairs 305A-D, an overall shield 315 formed around the plurality of twisted pairs 305A-D, and a jacket 320 formed around the overall shield 315. Additionally, one or more drain wires 325 may be incorporated into the cable 300.

As shown in FIG. 3, a respective separator/shield structure may be utilized to form the individual shields 310A-D for the plurality of twisted pairs 305A-D. Each structure (generally referred to as structure 310) may include a first portion that is positioned between the conductors of a twisted pair 305 and at least one second portion including shielding material that is wrapped around an outer periphery of the twisted pair 305. As shown, two second portions respectively extend from each end of the first portion, and each of the second portions is wrapped around the outer periphery of the twisted pair 305. As desired, a first or central portion may be formed with a wide variety of suitable cross-sectional shapes and/or from a wide variety of suitable materials. As shown in FIG. 3, the first portion may be formed as a dielectric film and one or more second portions may extend from the first portion. As desired, the first portion and the second portion(s) may share one or more common layers of material, such as a common dielectric or base layer on which shielding material may be formed within the second portion(s). In other embodiments, a first portion may have a shape that forms one or more channels into which the conductors of the twisted pair 305 may be positioned. Indeed, a suitable structure 305 may be formed with a wide variety of suitable shapes and/or constructions. In addition to providing separation between and/or positioning of the conductors of a twisted pair 305, a structure may also form an individual shield for the twisted pair 305. A few examples of suitable structures are described in U.S. patent application Ser. No. 14/742,147, filed Jun. 17, 2015 and entitled "Communication Cables Incorporating Twisted Pair Separators That Function as Shields", the entire contents of which are incorporated by reference herein.

The cable of FIG. 3 also illustrates a drain wire 325 that is positioned between two layers of the overall shield 315. For example, a drain wire 325 may be positioned between a dielectric layer of the overall shield 315 and one of the shielding layers (e.g., the innermost shielding layer as illustrated, the outermost shielding layer, etc.). As a result of the two shielding layers being electrically bonded both two one another and to the individual shield layers 310A-D, the drain 325 may be utilized to ground both the overall shield 315 and the individual shield layers 310A-D.

With continued reference to FIG. 3, in certain embodiments, a suitable separator 330 or filler may be incorporated into the cable 300. For example, a separator 330 may be positioned between two or more of the twisted pairs 305A-D. In certain embodiments, the separator 330 may be configured to orient and or position one or more of the twisted pairs 305A-D. The orientation of the twisted pairs 305A-D relative to one another may provide beneficial signal performance. As desired in various embodiments, the separator 330 may be formed in accordance with a wide variety of suitable dimensions, shapes, or designs. The illustrated separator 330 has an approximately cross-shaped cross-section; however, in other embodiments, a separator 330 may have any other suitable cross-sectional shape. As other examples, a flat separator, a T-shaped separator, a Y-shaped separator, a J-shaped separator, an L-shaped separator, a separator having any number of spokes extending from a central point, a separator having walls or channels with varying thicknesses, a separator having T-shaped members extending from a central point or center member, a separator including any number of suitable fins, and/or a wide variety of other shapes may be utilized.

In certain embodiments, a separator 330 may include shielding material, such as a suitable shielding layer (e.g., a metallic foil layer, etc.). Accordingly, a separator 330 may provide shielding for one or more of the twisted pairs 305A-D. Additionally, in certain embodiments, the separator 330 may provide or form individual shields for one or more of the twisted pairs 305A-D either by itself or in conjunction with one or more other cable components. For example, in the event that shielding material is incorporated into the cross-shaped separator 330 illustrated in FIG. 3, a second shield layer may be formed around a plurality of twisted pairs 305A-D, and the second shield layer may be in electrical contact with the separator 330. The combination of the separator 330 and the second shield layer may form respective individual shield layers for each of the twisted pairs 305A-D. Thus, in certain embodiments, the separator 330 and second shield layer may replace other individual shield layers. In other embodiments, the separator 330 and second shield layer may be utilized in conjunction with other individual shield layers.

In other embodiments, the separator 330 may include a central portion (e.g., a cross-shaped portion, etc.) that is positioned between the twisted pairs 305A-D and one or more extending portions that extend from the central portion beyond an outer periphery occupied by the twisted pairs 305A-D. For example, one or more prongs of a cross-shaped separator may extend beyond the outer periphery of the twisted pairs 305A-D. In certain embodiments, the one or more extending portions may be wrapped or curled around the outer periphery of the twisted pairs 305A-D in order to form one or more individual shield layers for the twisted pairs. For example, in the event that the separator 330 incorporates shielding material, the separator 330 may be positioned between the twisted pairs 305A-D, and the separator may include portions wrapped around the twisted pairs 305A-D. Accordingly, the separator 330 may form individual shield layers for one or more of the twisted pairs 305A-D. The individual shield layers formed by the separator 330 may be exclusive of or in addition to other individual shield layers.

A separator 330 may be formed from a wide variety of suitable materials and/or combinations of materials as desired in various embodiments. For example, the separator 330 may be formed from paper, metals, alloys, various plastics, one or more polymeric materials, one or more polyolefins (e.g., polyethylene, polypropylene, etc.), one or more fluoropolymers (e.g., fluorinated ethylene propylene ("FEP"), melt processable fluoropolymers, MFA, PFA, ethylene tetrafluoroethylene ("ETFE"), ethylene chlorotrifluoroethylene ("ECTFE"), etc.), one or more polyesters, polyvinyl chloride ("PVC"), one or more flame retardant olefins (e.g., flame retardant polyethylene ("FRPE"), flame retardant polypropylene ("FRPP"), a low smoke zero halogen ("LSZH") material, etc.), polyurethane, neoprene, choloro-sulphonated polyethylene, flame retardant PVC, low temperature oil resistant PVC, flame retardant polyurethane, flexible PVC, one or more semi-conductive materials (e.g., materials that incorporate carbon, etc.), one or more dielectric shielding materials (e.g., barium ferrite, etc.) or any other suitable material or combination of materials. In certain embodiments, the separator 330 may have a relatively flexible body. As desired, the separator 330 may be filled, unfilled, foamed, un-foamed, homogeneous, or inhomogeneous and may or may not include additives (e.g., flame retardant materials, smoke suppressant materials, strength members, water swallable materials, water blocking materials, etc.). In other embodiments, the separator 330 may be formed from one or more tape structures that include any number of suitable dielectric and/or shielding layers. For example, a single tape may be positioned between two sets of pairs such that it bisects a cable core. As another example, a single tape may be folded into a desired cross-sectional shape, such as a cross-shaped separator structure. As yet another example, a combination of tapes (e.g., two tapes folded at approximately right angles and positioned in proximity to one another or bonded between the plurality of twisted pairs) may be utilized to form a separator 330. A few examples of separators that are formed from a plurality of tapes are described in U.S. patent application Ser. No. 15/227,365, filed Aug. 12, 2016 and entitled "Communication Cables Incorporating Separator Structures", the entire contents of which are incorporated by reference herein. Indeed, a separator 330 may be formed with a wide variety of suitable constructions.

In certain embodiments, the separator 330 may be formed without incorporating shielding material. For example, the separator 330 may be formed from suitable dielectric materials. In other embodiments, electromagnetic shielding material may be incorporated into the separator 330. A wide variety of different types of materials may be utilized to provide shielding, such as electrically conductive material, semi-conductive material, and/or dielectric shielding material. A few examples of suitable materials are described in greater detail above with reference to other shielding layers. In certain embodiments, shielding material may be formed on one or more surfaces of the separator 330. For example, shielding material may be formed on an external surface of the separator 330. In other embodiments, shielding material may be embedded within the body of the separator 330. In yet other embodiments, a separator 330 may be formed from one or more suitable shielding materials. Additionally, in certain embodiments, the separator 330 may include shielding material and/or one or more shielding layers that are continuous along the longitudinal length of the separator 330.

As desired in various embodiments, a wide variety of other materials may be incorporated into the cables 200, 300 of FIGS. 2 and 3 as discussed above with reference to FIG. 1. The cables 200, 300 illustrated in FIGS. 2 and 3 are provided by way of example only. Embodiments of the disclosure contemplate a wide variety of other cables and cable constructions. These other cables may include more or less components than the cables 200, 300 illustrated in FIGS. 2 and 3. Additionally, certain components may have different dimensions and/or materials than the components illustrated in FIGS. 2 and 3.

Figure 4A:
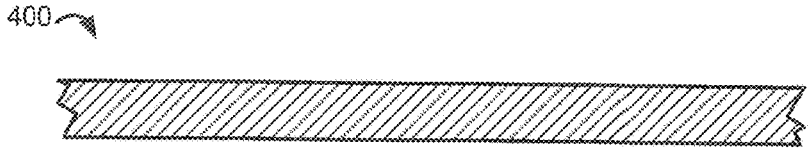
FIGS. 4A-4B illustrate cross-sectional views of example individual twisted pair shield constructions, according to illustrative embodiments of the disclosure.
Figure 4B:
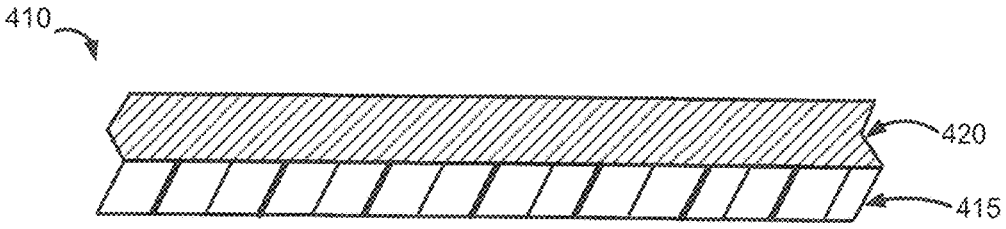

As set forth above, an individual shield may be formed with any number of layers and/or from any suitable materials or combinations of materials. FIGS. 4A-4B illustrate cross-sectional views of example individual twisted pair shield constructions, according to illustrative embodiments of the disclosure. With reference to FIG. 4A, in certain embodiments, an individual shield 400 may be formed from a single layer of shielding material. For example, the individual shield 400 may be formed from a single layer of metallic foil material. In other embodiments, an individual shield 400 may be formed from a plurality of layers of shielding material. In yet other embodiments, as shown in FIG. 4B, an individual shield 410 may be formed with one or more dielectric layers and one or more shielding layers. For example, an individual shield 410 may include a base dielectric layer 415 and a shielding layer 420, such as a metallic foil layer, may be formed on the dielectric layer 415. A wide variety of other suitable constructions may be utilized to form an individual shield, and those discussed herein are provided by way of non-limiting example only. Additionally, any of the individual shield constructions may be incorporated into a wide variety of cables, such as the cables 100, 200, 300 discussed above with reference to FIGS. 1-3.

Figure 5A:
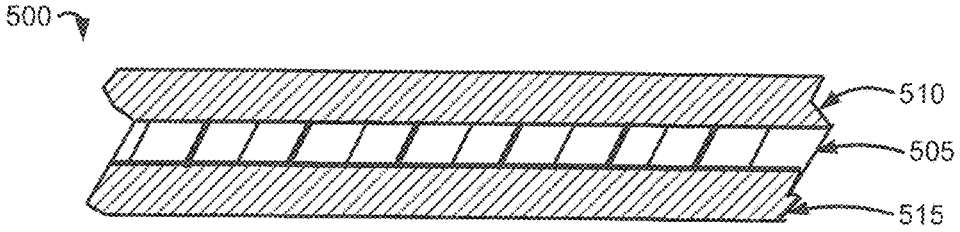
FIGS. 5A-5B illustrate cross-sectional views of example overall shield constructions, according to illustrative embodiments of the disclosure.
Figure 5B:
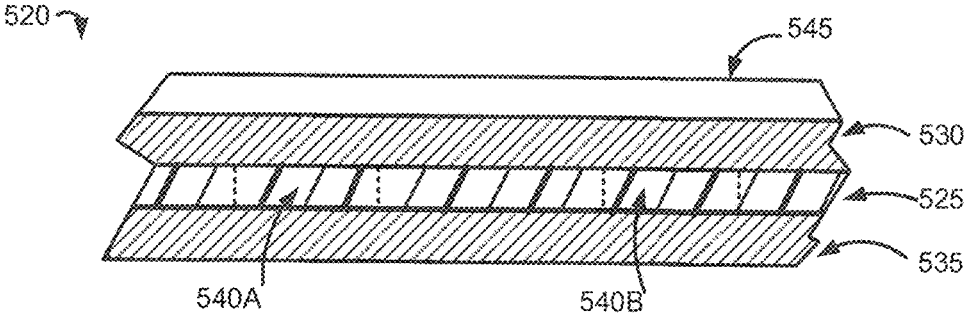

Additionally, an overall shield may be formed with any number of layers and/or from any suitable materials or combinations of materials. FIGS. 5A-5B illustrate cross-sectional views of example overall shield constructions, according to illustrative embodiments of the disclosure. With reference to FIG. 5A, in certain embodiments, an overall shield 500 may include a base dielectric layer 505 and two layers of shielding material 510, 515 respectively formed on opposite sides (i.e., a top surface and a bottom surface) of the dielectric layer 505. For example, metallic foil layers may be formed on opposite sides of a dielectric layer. Additionally, according to an aspect of the disclosure, the two layers of shielding material 510, 515 may be electrically joined to one another. For example, when the overall shield 500 is wrapped around a plurality of twisted pairs, the two layers of shielding material 510, 515 may contact one another. In other embodiments, as illustrated in FIG. 5B, an overall shield 520 may include a dielectric layer 525 and two shielding layers 530, 535 that are electrically joined to one another via one or more gaps or spaces 540A, 540B formed through the dielectric layer 525. Each gap (generally referred to as gap 540) may have any suitable dimensions (e.g., widths, longitudinal lengths, etc.) as desired. Additionally, FIG. 5B illustrates an adhesive layer 545, such as a layer of self-lubricating adhesive, formed on the outermost or top shielding layer 535. As desired, an overall shield 515 may include additional layers, such as additional dielectric and shielding layers. For example, a shielding layer 530, 535 may be formed from a plurality of separate layers of shielding material (e.g., a plurality of metallic foil layers, a metallic foil layer formed on a layer of semi-conductive material, etc.). A wide variety of other suitable constructions may be utilized to form an overall shield, and those discussed herein are provided by way of non-limiting example only. Additionally, any of the overall shield constructions may be incorporated into a wide variety of cables, such as the cables 100, 200, 300 discussed above with reference to FIGS. 1-3.

Figure 6A:
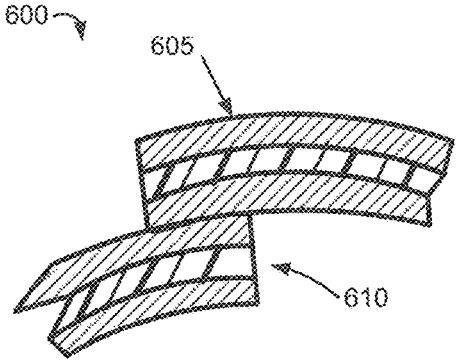
FIGS. 6A-6D illustrate example techniques for electrically shorting layers of electrically conductive material in a shield structure, according to illustrative embodiments of the disclosure.

As set forth above, the shielding layers of an overall shield may be electrically connected to one another via a wide variety of suitable techniques. FIGS. 6A-6D illustrate example techniques for electrically shorting layers of electrically conductive material in a shield structure, according to illustrative embodiments of the disclosure. Turning first to FIG. 6A, a first example overall shield 600 is illustrated in which an overlap is formed when the shield 600 is wrapped around a plurality of twisted pairs, thereby forming an electrical connection between two shielding layers. For example, a first widthwise edge 605 may overlap a second widthwise edge 610 when the shield 600 is wrapped or curled around the twisted pairs. The first widthwise edge 605 may be utilized to form any desirable overlap region with respect to an underlying portion of the shield 600. As shown, a relatively small overlap region may be formed. In other embodiments, an overlap region may occupy a larger circumferential area of the shield 600, such as an area of approximately 25, 30, 40, 50, 60, 70, 80, or 90 percent of the circumferential area of the shield. In yet other embodiments, an overlap region may occupy more than 100 percent of the circumferential area, thereby forming a double-wrapped shield, a triple-wrapped shield, etc.

Figure 6B:
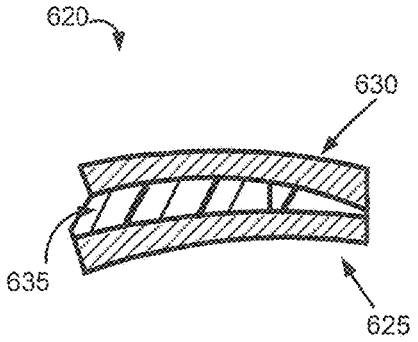

FIG. 6B illustrates a second example overall shield 620 in which at least one of the shielding layers 625, 630 may extend beyond an edge (e.g., a longitudinally extending widthwise edge, etc.) of a dielectric layer 635. As shown, both shielding layers 625, 630 may extend beyond the dielectric layer 635, and the shielding layers 625, 630 may contact one another in order to form an electrical connection. In other embodiments, a single shielding layer may extend beyond the dielectric layer 635, and the extending shielding layer may be folded or wrapped around the dielectric layer 635 in order to form an electrical connection with the other shielding layer. As desired, one or more shielding layers 625, 630 may extend beyond the dielectric layer at any number of suitable locations. For example, in certain embodiments, a shielding layer 625, 630 may continuously extend beyond the dielectric layer in a longitudinal direction. In other embodiments, a shielding layer 625 630 may extend beyond the dielectric layer at a plurality of longitudinally spaced locations, and the longitudinally spaced locations may be arranged in any suitable pattern or, alternatively, in a random or pseudo-random manner.

Figure 6C:
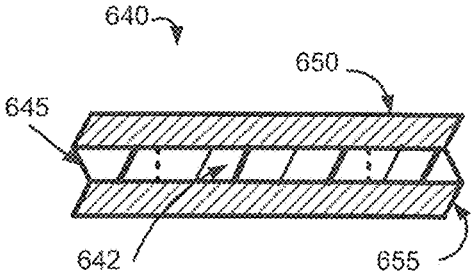
Figure 6D:
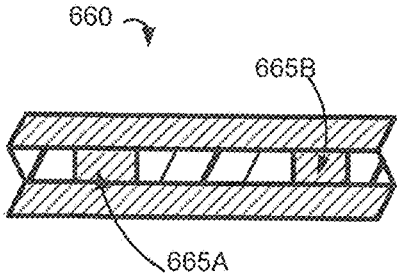

FIG. 6C illustrates a third example overall shield 640 in which one or more gaps 652 may be formed through a dielectric layer 645 to facilitate electrical contact between two shielding layers 650, 655. Similarly, FIG. 6D illustrates a fourth example overall shield 660 in which one or more electrically conductive vias 665A, 665B may be formed through a dielectric layer to facilitate electrical contact between two shielding layers. As desired in various embodiments, gaps and/or electrical vias may be formed with any suitable dimensions, such as any suitable widths, longitudinally lengths, areas, etc. Additionally, any number of gaps and/or electrical vias may be utilized as desired in various embodiments. In the event that a plurality of gaps and/or vias are utilized, the gaps and/or vias may be arranged in accordance with any suitable pattern or, alternatively, in a random or pseudo-random manner. A wide variety of other suitable methods and/or techniques may be utilized as desired to electrically connect a plurality of shielding layers in an overall shield. Those described herein are provided by way of non-limiting example only. Additionally, in certain embodiments, a plurality of different techniques may be combined.

Figure 7:
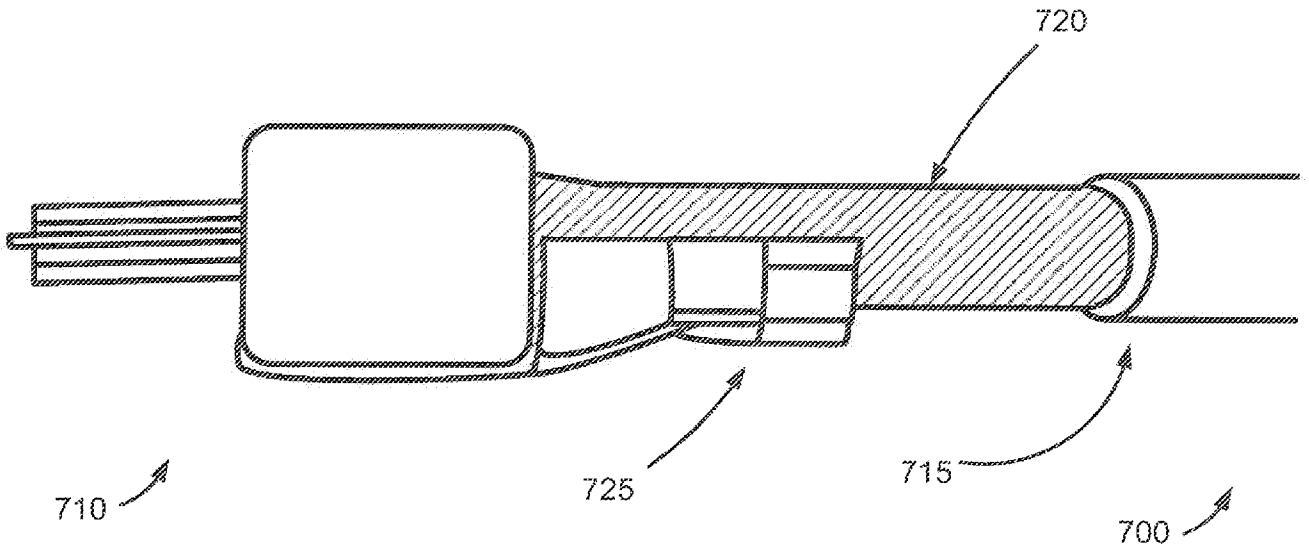
FIG. 7 illustrates an example cable in which an overall shield is terminated at a connector, according to an illustrative embodiment of the disclosure.

In certain embodiments, the use of a plurality of bonded shielding layers (e.g., electrically bonded individual shields and an overall shield, etc.) may provide for or facilitate easier grounding of a cable at termination. For example, in certain embodiments, a drain wire in contact with one of the shielding layers may be grounded at termination. In other embodiments, one of the shielding layers may be grounded at termination. For example, one of the shielding layers may be grounded to a connector when a cable is terminated, thereby grounded all of the bonded shielding layers. FIG. 7 illustrates an example cable 700 in which an overall shield 705 is terminated or grounded to a connector 710. For example, a portion of the cable jacket 715 may be removed or stripped in order to expose the overall shield 720. The overall shield 720 may then be brought into contact with a portion of the connector 710, such as a connector cap 725 or hood. In this regard, the overall shield 720 and other shielding layers of the cable 700 that are electrically bonded to the overall shield 720 may be grounded at the connector 710.

Conditional language, such as, among others, "can," "could," "might," or "may," unless specifically stated otherwise, or otherwise understood within the context as used, is generally intended to convey that certain embodiments could include, while other embodiments do not include, certain features, elements, and/or operations. Thus, such conditional language is not generally intended to imply that features, elements, and/or operations are in any way required for one or more embodiments or that one or more embodiments necessarily include logic for deciding, with or without user input or prompting, whether these features, elements, and/or operations are included or are to be performed in any particular embodiment.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A cable comprising:

a plurality of twisted pairs of individually insulated electrical conductors extending in a longitudinal direction;

a respective individual shield formed around each of the twisted pairs, each individual shield comprising electrically conductive material that is continuous in the longitudinal direction;

an overall shield formed around the plurality of twisted pairs and individual shields, the overall shield comprising:

a dielectric layer;

a first layer of electrically conductive material that is continuous in the longitudinal direction and that is formed on a first surface of the dielectric layer, the first layer of electrically conductive material in direct contact with the respective electrically conductive material of each of the individual shields; and a second layer of electrically conductive material that is continuous in the longitudinal direction and that is formed on a second surface of the dielectric layer opposite the first surface, wherein the first layer of electrically conductive material and the second layer of electrically conductive material are in continuous contact with one another along the longitudinal direction of the cable; and a jacket formed around the overall shield.

2. The cable of claim 1, wherein the cable comprises a Category 8 cable capable of transmission rates greater than approximately 600 MHz.

3. The cable of claim 1, wherein the first layer of electrically conductive material, the second layer of electrically conductive material, and each of the individual shields comprise metallic foil.

4. The cable of claim 1, wherein each of the individual shields comprises:

a base dielectric layer; and a metallic foil layer formed on a surface of the base dielectric layer opposite the twisted pair surrounded by the individual shield.

5. The cable of claim 1, further comprising a drain wire in contact with at least one of (i) the overall shield or (ii) one or more of the individual shields.

6. The cable of claim 5, wherein the drain wire is positioned between the plurality of individually shielded twisted pairs.

7. The cable of claim 5, wherein the drain wire is positioned between two layers of the overall shield.

8. The cable of claim 1, wherein the overall shield is grounded to an external connector.

9. The cable of claim 1, wherein the first and second layers of electrically conductive material are in continuous contact with one another via an overlap formed along a longitudinally extending widthwise edge of the overall shield.

10. The cable of claim 1, wherein the first and second layers of electrically conductive material are in continuous contact with one another via at least one of (i) the first layer of electrically conductive material or the second layer of electrically conductive material extending beyond a widthwise edge of the dielectric layer or (ii) one or more gaps formed through the dielectric layer.

11. A cable comprising:

a plurality of individually shielded twisted pairs, each twisted pair comprising two individually insulated electrical conductors surrounded by a shield layer comprising a dielectric base adjacent to the electrical conductors and longitudinally continuous electrically conductive material formed on the dielectric base opposite the electrical conductors;

an overall shield formed around the plurality of individually shielded twisted pairs, the overall shield comprising:

a dielectric layer; and first and second layers of longitudinally continuous electrically conductive material formed on opposite sides of the dielectric layer, wherein the first layer of electrically conductive material of the overall shield is in direct contact with the respective electrically conductive material of each of the plurality of individually shielded twisted pair, and wherein the first and second layers of electrically conductive material of the overall shield are in continuous contact with one another along a longitudinal length of the cable; and a jacket formed around the overall shield.

12. The cable of claim 11, wherein the cable comprises a Category 8 cable capable of transmission rates greater than approximately 600 MHz.

13. The cable of claim 11, wherein the first and second layers of electrically conductive material of the overall shield and each respective layer of electrically conductive material included in the individual shields comprises metallic foil.

14. The cable of claim 11, further comprising a drain wire in contact with at least one of (i) the overall shield or (ii) one or more of the individual shields.

15. The cable of claim 14, wherein the drain wire is positioned (i) between one of the plurality of individually shielded twisted pairs, (ii) between the individually shielded twisted pairs and the overall shield, or (iii) between two layers of the overall shield.

16. The cable of claim 11, wherein the overall shield is grounded to an external connector.

17. The cable of claim 11, wherein the first and second layers of electrically conductive material of the overall shield are in continuous contact with one another via an overlap formed along a longitudinally extending widthwise edge of the overall shield.

18. The cable of claim 11, wherein the first layer and the second layers of electrically conductive material of the overall shield are in continuous contact with one another via at least one of (i) the first layer or the second layer of electrically conductive material extending beyond a widthwise edge of the dielectric layer, or (ii) one or more gaps formed through the dielectric layer.

19. A cable comprising:

a plurality of twisted pairs of individually insulated conductors, each twisted pair surrounded by a respective individual shield layer comprising continuous metallic foil;

an overall shield formed around the plurality of individually shielded twisted pairs, the overall shield comprising:

a dielectric layer; and first and second continuous metallic foil layers formed on opposite sides of the dielectric layer, wherein the first continuous metallic foil layer of the overall shield is in direct contact with the respective continuous metallic foil of each of the plurality of individual shield layers along a longitudinal length of the cable, and wherein the first and second metallic foil layers of the overall shield are in continuous contact with one another alone the longitudinal length of the cable; and a jacket formed around the overall shield.

20. The cable of claim 19, wherein the cable comprises a Category 8 cable capable of transmission rates greater than approximately 600 MHz.

* * * * *